US009462831B2

(12) United States Patent
Liu

(10) Patent No.: US 9,462,831 B2
(45) Date of Patent: Oct. 11, 2016

(54) ELECTRONIC CIGARETTE AND ELECTRODE ASSEMBLY THEREOF

(71) Applicant: Qiuming Liu, Shenzhen (CN)

(72) Inventor: Qiuming Liu, Shenzhen (CN)

(73) Assignee: Huizhou Kimree Technology Co., Ltd. Shenzhen Branch, Shenzhen, Guangdong (CN)

( * ) Notice: Subject to any disclaimer, the term of this patent is extended or adjusted under 35 U.S.C. 154(b) by 447 days.

(21) Appl. No.: 14/003,431

(22) PCT Filed: Jul. 23, 2013

(86) PCT No.: PCT/CN2013/079863
§ 371 (c)(1),
(2) Date: Sep. 5, 2013

(87) PCT Pub. No.: WO2015/006990
PCT Pub. Date: Jan. 22, 2015

(65) Prior Publication Data

US 2015/0013701 A1 Jan. 15, 2015

(30) Foreign Application Priority Data

Jul. 15, 2013 (CN) ..... 2013 2 0419241 U

(51) Int. Cl.
*A24F 47/00* (2006.01)

(52) U.S. Cl.
CPC ..... *A24F 47/008* (2013.01)

(58) Field of Classification Search
CPC A24F 47/002; A24F 47/008; A61M 11/042; A61M 15/06
USPC ..... 439/10, 11, 13, 20, 21, 23, 28; 131/328, 131/329, 273; 128/202.21
See application file for complete search history.

(56) References Cited

U.S. PATENT DOCUMENTS

| | | | | |
|---|---|---|---|---|
| 8,678,012 | B2 * | 3/2014 | Li | A24F 47/008 128/202.21 |
| 2013/0192622 | A1 * | 8/2013 | Tucker | H01C 17/00 131/329 |
| 2013/0228191 | A1 * | 9/2013 | Newton | A24F 47/008 131/329 |

FOREIGN PATENT DOCUMENTS

| | | | |
|---|---|---|---|
| CN | 101843368 | A | 9/2010 |
| CN | 101862038 | A | 10/2010 |
| CN | 21916960 | U | 8/2011 |
| CN | 202198998 | U | 4/2012 |
| JP | 2004166660 | A | 6/2004 |

* cited by examiner

*Primary Examiner* — Vanessa Girardi
(74) *Attorney, Agent, or Firm* — Schwabe Williamson & Wyatt

(57) ABSTRACT

The present application provides an electrode assembly including an atomizer outer electrode, an atomizer inner electrode, a battery rod outer electrode and a battery rod inner electrode assembly, all of which being configured to form an electrically conductive loop, wherein, the atomizer outer electrode provided on the atomizer is of a cylindrical shape; the battery rod outer electrode of a cylindrical shape arranged on the battery rod is configured to be inserted into or sleeved outside the atomizer outer electrode, and then is coupled to the atomizer outer electrode by rotating either the battery rod outer electrode or the atomizer outer electrode, so as to form an electrical connection in a surface contact manner; and the atomizer inner electrode provided on the atomizer is in contact with and electrically connected to the battery rod inner electrode assembly provided on the battery rod.

13 Claims, 11 Drawing Sheets

ELECTRONIC CIGARETTE AND ELECTRODE ASSEMBLY THEREOF

The present application is the national phase of International Application No. PCT/CN2013/079863, entitled "ELECTRONIC CIGARETTE AND ELECTRODE ASSEMBLY THEREOF", filed on Jul. 23, 2013, which claims the benefit of priority to Chinese Patent Application No. 201320419241.0, entitled "ELECTRONIC CIGARETTE AND ELECTRODE ASSEMBLY THEREOF", and filed with the Chinese State Intellectual Property Office on Jul. 15, 2013, the entire disclosure of which is incorporated herein by reference.

FIELD OF THE INVENTION

The present application relates to the technical field of accessories of an electronic cigarette, particularly to an electrode assembly. The present application further relates to an electronic cigarette having the electrode assembly.

BACKGROUND OF THE INVENTION

An electronic cigarette is a common electronic cigarette simulation product, which mainly includes a tar storage cotton, an atomizing device and a battery. The battery supplies electric energy for the atomizing device, such that the atomizing device generates heat and vaporizes tar in the tar storage cotton to emit smoke, thereby simulating the real cigarette.

As shown in FIGS. 1 to 3, the electronic cigarette generally includes two parts, namely a atomizer 01 and a battery rod 02. The atomizer 01 is provided with an atomizing device 03 and a tar storage cotton, the battery rod 02 is provided with a battery 04, and the atomizer 01 and the battery rod 02 are connected via plastic seats 05 respectively arranged on connecting ends of the atomizer 01 and the battery rod 02. The atomizing device 03 and the battery 04 are each connected with two needle electrodes. The two needle electrodes 06 arranged on the atomizer 01 are electrically connected to the atomizing device 03 via a wire, and the two needle electrodes 06 arranged on the battery rod 02 are electrically connected to the battery 04 via a Printed Circuit Board 07 (PCB, which functions as a bearing body for electronic components and wirings). The needle electrodes 06 are arranged on the atomizer 01 and the battery rod 02 via the plastic seats 05, respectively. A periphery surface of the plastic seat 05 on the atomizer 01 is provided with a protruding clamping block 08, and a periphery surface of the plastic seat 05 on the battery rod 02 is provided with a clamping groove 09 extending in an axial direction of the battery rod 02 and configured to receive the clamping block 08. When the atomizer 01 and the battery rod 02 are required to be coupled, the clamping block 08 is inserted into the clamping groove 09, and is kept moving further until it completely passes through the clamping groove 09, then the atomizer 01 is rotated, such that the clamping block 08 and the clamping groove 09 are not located in the same line, which may prevent the clamping block 08 from sliding out of the clamping groove 09 in a reverse direction. At this time, the atomizer 01 and the battery rod 02 are coupled via the clamping block 08. Further, after the atomizer 01 is rotated, the two needle electrodes 06 on the plastic seat 05 of the atomizer 01 are respectively in contact with the two needle electrodes 06 on the plastic seat 05 of the battery rod 02, thereby realizing the electrical connection between the atomizing device 03 and the battery 04.

In the above structure, the atomizer 01 is electrically connected to the battery 04 via the contact between the needle electrodes 06 on the plastic seats 05. An outer lateral surface of each of the needle electrodes 06 of a rod shape is an arc surface. When two needle electrodes 06 are in contact with each other, since axes of two arc surfaces are not in the same line, arcs of the two arc surfaces in contact are extending in opposite directions. As a result, the two arc surfaces in contact are in point contact or in line contact with each other, and the contacting area is small, which may easily cause a poor contact, and in this situation the battery 04 can not supply electric energy for the atomizing device 03 normally, thereby affecting normal use of the electronic cigarette.

Therefore, a technical problem to be solved presently by those skilled in the art is to reduce or avoid the occurrence of the poor contact between the electrodes of the atomizing device and the battery.

SUMMARY OF THE INVENTION

In view of this, the present application provides an electrode assembly, which can reduce or avoid the occurrence of a poor contact between an electrode of an atomizing device and an electrode of a battery, and can provide a further security guarantee for normal operation of an electronic cigarette. The present application further provides an electronic cigarette having the above electrode assembly.

In order to achieve the above objects, the present application provides the following technical solutions.

An electrode assembly for realizing an electrical connection between an atomizer and a battery rod of an electronic cigarette in a manner of inserting, rotating and coupling, includes an atomizer outer electrode, an atomizer inner electrode, a battery rod outer electrode and a battery rod inner electrode assembly, all of which being configured to form an electrically conductive loop, wherein, the atomizer outer electrode provided on the atomizer is of a cylindrical shape;

the battery rod outer electrode of a cylindrical shape arranged on the battery rod is configured to be inserted into or sleeved outside the atomizer outer electrode, and then is coupled to the atomizer outer electrode by rotating either the battery rod outer electrode or the atomizer outer electrode; and the atomizer inner electrode provided on the atomizer is in contact with and electrically connected to the battery rod inner electrode assembly provided on the battery rod.

Preferably, in the above electrode assembly a protruding rib is provided on an outer periphery surface of one of the atomizer outer electrode and the battery rod outer electrode each being arranged on a connecting end, and a groove configured to receive the protruding rib is provided on an inner periphery surface of the other of the atomizer outer electrode and the battery rod outer electrode each being arranged on the connecting end.

Preferably, in the above electrode assembly, there is one or more protruding ribs, and a number and a location of the groove cooperated with the protruding rib are corresponding to a number and a location of the protruding rib.

Preferably, in the above electrode assembly, the atomizer inner electrode is a rod-shaped electrode and is arranged in an inner cavity of the atomizer outer electrode via an insulating ring.

Preferably, in the above electrode assembly, the battery rod inner electrode assembly is arranged in an inner cavity of the battery rod outer electrode via an insulating electrode holder.

Preferably, in the above electrode assembly, the electrode holder is provided with a mounting hole, and the battery rod inner electrode assembly is arranged in the mounting hole; and in the case of the groove being arranged on the battery rod outer electrode, an inner periphery surface of the electrode holder is provided with a stopping groove extending in a circumferential direction of the electrode holder, and the groove on the battery rod outer electrode and the stopping groove form a sliding groove having an angle ranged from 30° to 120°.

Preferably, in the above electrode assembly, the battery rod inner electrode assembly includes:

an inner electrode body configured to be in contact with and electrically connected to the atomizer inner electrode, an inner electrode sleeve arranged in the mounting hole of the electrode holder and electrically connected to a battery; and a compression spring arranged between the inner electrode body and the battery of the electronic cigarette, and having two ends respectively abutting against the inner electrode body and the inner electrode sleeve.

Preferably, in the above electrode assembly, the electrode body is a cylindrical electrode having a base.

Preferably, in the above electrode assembly, the battery rod outer electrode is electrically connected to a battery of the electronic cigarette.

Based on the above electrode assembly, the present application further provides an electronic cigarette including an atomizer, a battery rod, and an electrode assembly for electrically connecting the atomizer to the battery rod, wherein the electrode assembly is one of the above described electrode assembly.

The electrode assembly according to the present application includes the cylindrical atomizer outer electrode arranged on the atomizer, the cylindrical battery rod outer electrode arranged on the battery rod and configured to contact the atomizer outer electrode 3 in a sleevedly coupling manner, the atomizer inner electrode arranged on the atomizer, and the battery rod inner electrode assembly arranged on the battery rod and configured to be electrically connected to the atomizer inner electrode. The atomizer outer electrode is insulated, from the atomizer inner electrode, and the battery rod outer electrode is insulated from the battery rod inner electrode assembly, so as to avoid a short circuit of a conductive circuit. Since the atomizer outer electrode and the battery rod outer electrode each have a cylindrical structure, when the atomizer and the battery rod are required to be electrically connected, the atomizer outer electrode is inserted into the battery rod outer electrode, and after reaching an appropriate place, the atomizer outer electrode is rotated so as to be coupled to the battery rod outer electrode, such that the battery rod outer electrode and the atomizer outer electrode are in contact with each other in a sleevedly coupling manner. That is, axes of the atomizer outer electrode and the battery rod outer electrode being sleevedly connected are located in the same line, and arcs of arc surfaces of the atomizer outer electrode and the battery rod outer electrode are extending in the same direction. Therefore, the atomizer outer electrode and the battery rod outer electrode being electrically connected can contact with each other sufficiently via the arc surfaces thereof, and this contact manner is a surface contact. Therefore, compared to the conventional needle electrode, the electrode assembly according to the present application employs surface contact instead of point contact or line contact to increase the contact area, thereby reducing or avoiding the probability of occurrence of poor contact between the electrode of the atomizing device and the electrode of the battery, and providing a further security guarantee for normal operation of the electronic cigarette. The present application further provides an electronic cigarette having the above electrode assembly.

BRIEF DESCRIPTION OF THE DRAWINGS

For more clearly illustrating embodiments of the present application or the technical solution in the prior art, drawings referred to describe the embodiments or the prior art will be briefly described hereinafter. Apparently, the drawings in the following description are only several embodiments of the present application, and for the person skilled in the art other drawings may be obtained based on these drawings without any creative efforts.

Figure 1:
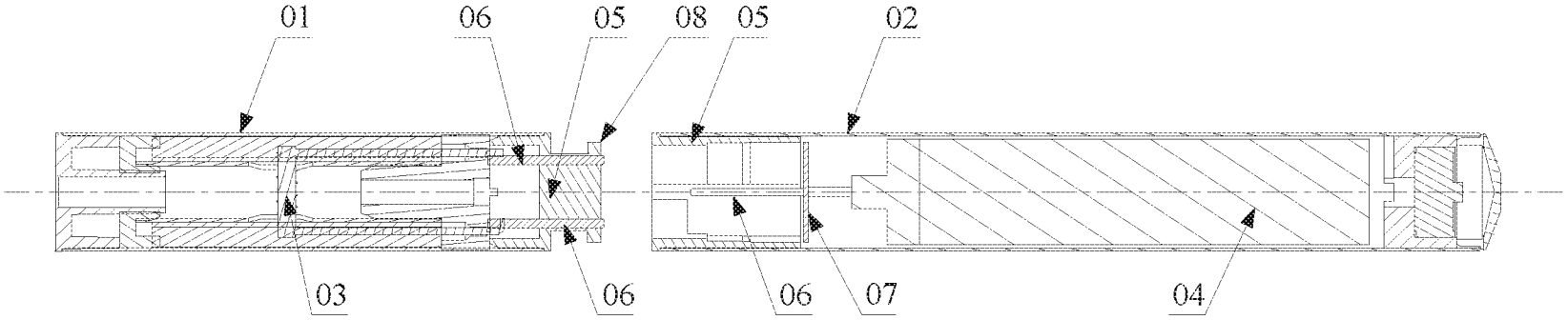
Fig. 1 Prior Art
FIG. 1 is a schematic view showing the structure of an electronic cigarette and an electrode assembly thereof in the prior art.
Figure 2:
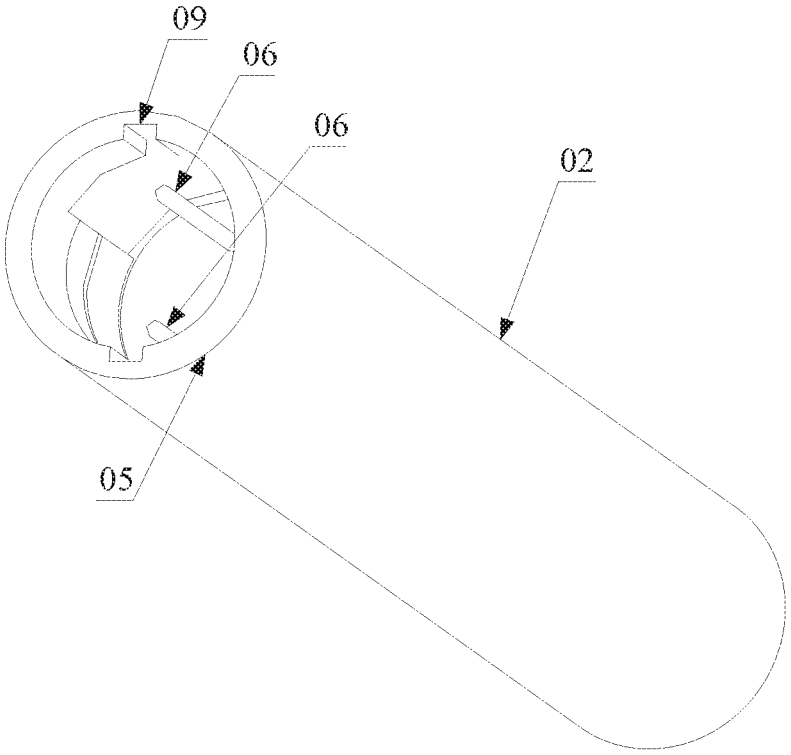
Fig. 2 Prior Art
FIG. 2 is a schematic view showing the structure of a battery rod.
Figure 3:
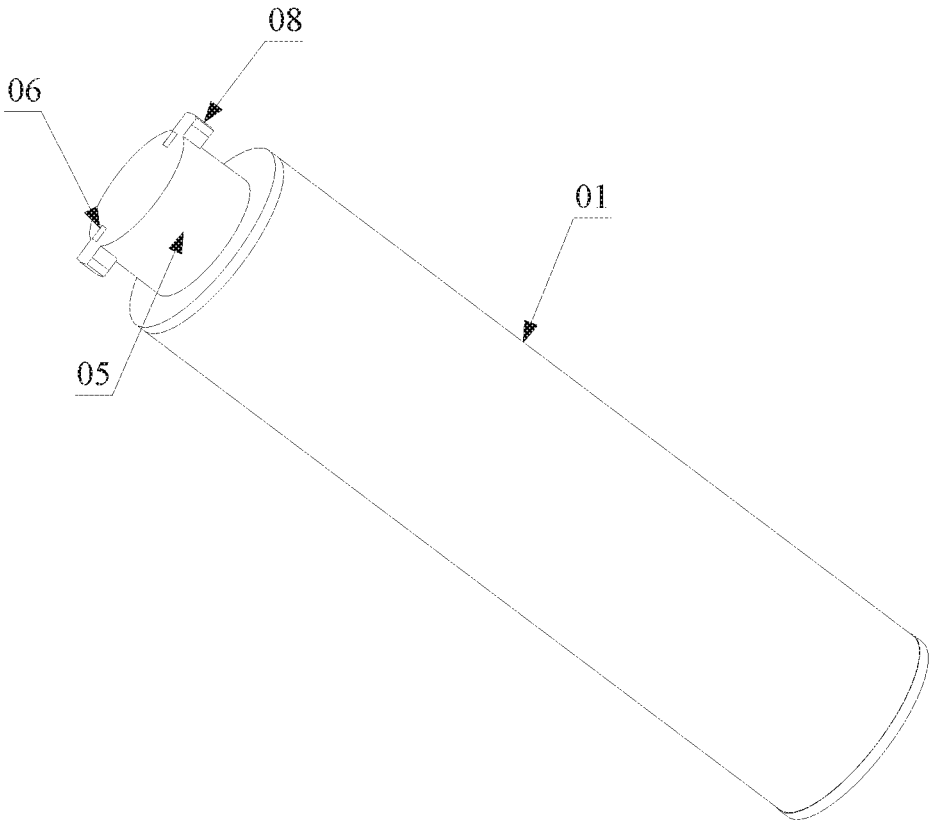
Fig. 3 Prior Art
FIG. 3 is a schematic view showing the structure of an atomizer.
Figure 4:
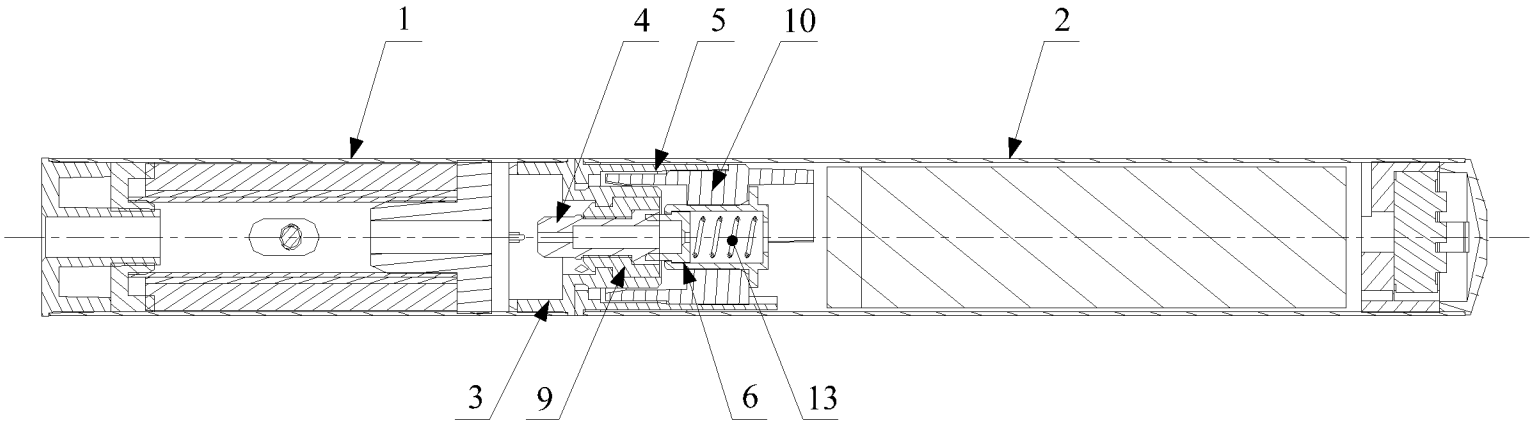
FIG. 4 is an assembly drawing of an electrode assembly according to an embodiment of the present application (as an example, one protruding rib is provided in this embodiment)
Figure 5:
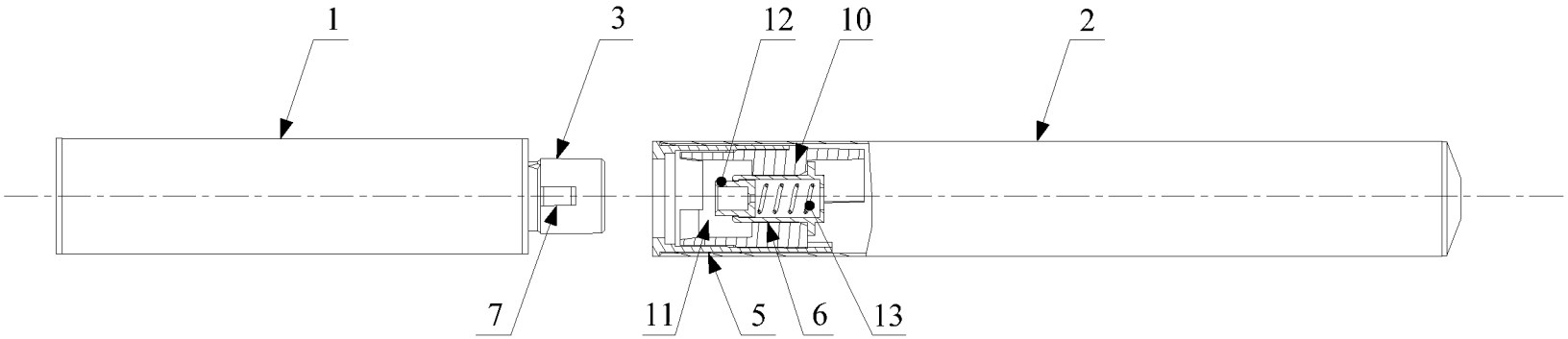
FIG. 5 is a schematic view showing the cooperation of the electrode assembly (as an example, one protruding rib is provided in this embodiment)

Reference numerals in FIGS. 1 to 13:

| | | |
|---|---|---|
| 01 atomizer, | 02 battery rod, | 03 atomizing device, |
| 04 battery, | 05 plastic seat, | 06 needle electrode, |
| 07 PCB, | 08 clamping block, | 09 clamping groove; |
| 1 atomizer, | 2 battery rod, | 3 atomizer outer electrode, |

-continued

| Reference numerals in FIGS. 1 to 13: | | |
|---|---|---|
| 4 atomizer inner electrode, | 5 battery rod outer electrode, | 6 inner electrode sleeve, |
| 7 protruding rib, | 8 groove, | 9 insulating ring, |
| 10 electrode holder, | 11 stopping groove, | 12 electrode body, and |
| 13 compression spring. | | |

DETAILED DESCRIPTION

The present application provides an electrode assembly, which can reduce or avoid the occurrence of a poor contact between an electrode of an atomizing device and an electrode of a battery, so as to provide a further security guarantee for normal operation of an electronic cigarette. The present application also provides an electronic cigarette having the above electrode assembly.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application.

In the present embodiment, as an example, a protruding rib 7 is arranged on an atomizer outer electrode 3, and a groove 8 is arranged on a battery rod outer electrode 5, which should not be construed as absolute limitation to the protection scope of the present application.

Referring to FIGS. 4 to 13, the electrode assembly according to the embodiment of the present application is used for electrically connecting an atomizer 1 to a battery rod 2 in a manner of inserting, rotating and coupling, and includes:

an atomizer outer electrode 3 of a cylindrical shape arranged on the atomizer 1;

an atomizer inner electrode 4 arranged on the atomizer 1 and being insulated from the atomizer outer electrode 3;

a battery rod outer electrode 5 of a cylindrical shape arranged on the battery rod 2, and the battery rod outer electrode 5 is configured to be inserted into or sleeved outside the atomizer outer electrode 3, and then is coupled to the atomizer outer electrode 3 by rotating either the battery rod outer electrode 5 or the atomizer outer electrode 3, so as to realize an electrical connection between the battery rod outer electrode 5 and the atomizer outer electrode 3; and a battery rod inner electrode assembly arranged on the battery rod 2, which is insulated from the battery rod outer electrode 5, and is configured to be electrically connected to the atomizer inner electrode 4.

The electrode assembly according to the present embodiment includes the cylindrical atomizer outer electrode 3 arranged on the atomizer 1, the cylindrical battery rod outer electrode 5 arranged on the battery rod 2 and configured to contact with the atomizer outer electrode 3 in a sleevedly coupling manner, the atomizer inner electrode 4 arranged on the atomizer 1, and the battery rod inner electrode assembly arranged on the battery rod 2 and configured to be electrically connected to the atomizer inner electrode 4. The atomizer outer electrode 3 is insulated from the atomizer inner electrode 4, and the battery rod outer electrode 5 is insulated from the battery rod inner electrode assembly, so as to avoid a short circuit of a conductive circuit. Since the atomizer outer electrode 3 and the battery rod outer electrode 5 each have a cylindrical structure, when the atomizer 1 and the battery rod 2 are required to be electrically connected, the atomizer outer electrode 3 is inserted into the battery rod outer electrode 5, and after reaching an appropriate place, the atomizer outer electrode 3 is rotated so as to be coupled to the battery rod outer electrode 5, such that the battery rod outer electrode 5 and the atomizer outer electrode 3 are in contact with each other in a sleevedly coupling manner. That is, axes of the atomizer outer electrode 3 and the battery rod outer electrode 5 being sleevedly connected are located in the same line, and arcs of arc surfaces of the atomizer outer electrode 3 and the battery rod outer electrode 5 are extending in the same direction. Therefore, the atomizer outer electrode 3 and the battery rod outer electrode 5 being electrically connected can contact with each other sufficiently via the arc surfaces thereof, and this contact manner is a surface contact.

Therefore, compared to the conventional needle electrode, the electrode assembly according to the present application employs surface contact instead of point contact or line contact to increase the contact area, thereby reducing or avoiding the probability of occurrence of poor contact between the electrode of the atomizing device and the electrode of the battery, and providing a further security guarantee for normal operation of the electronic cigarette.

In the present embodiment, the atomizer outer electrode 3 is arranged on a connecting end, connected to the battery rod 2, of the atomizer 1, the battery rod outer electrode 5 is arranged on a connecting end, connected to the atomizer 1, of the battery rod 2, and the battery rod outer electrode 5 is electrically connected to the battery directly. The atomizer outer electrode 3 and the battery rod outer electrode 5 are each configured to have a cylindrical structure, such that the contact area may be increased and the poor contact may be avoided. Further, the cylindrical atomizer outer electrode 3 and the cylindrical battery rod outer electrode 5 each have a certain connection strength, and are respectively arranged on the connecting end, connected to the battery rod 2, of the atomizer 1 and the connecting end, connected to the atomizer 1, of the battery rod 2, such that the atomizer outer electrode 3 and the battery rod outer electrode 5 each function as a connecting component to connect the atomizer 1 to the battery rod 2, thereby omitting the conventional plastic seats for connection, therefore not only the production cost is reduced, but also the manufacturing technique is simplified and the production efficiency is improved.

Figure 6:
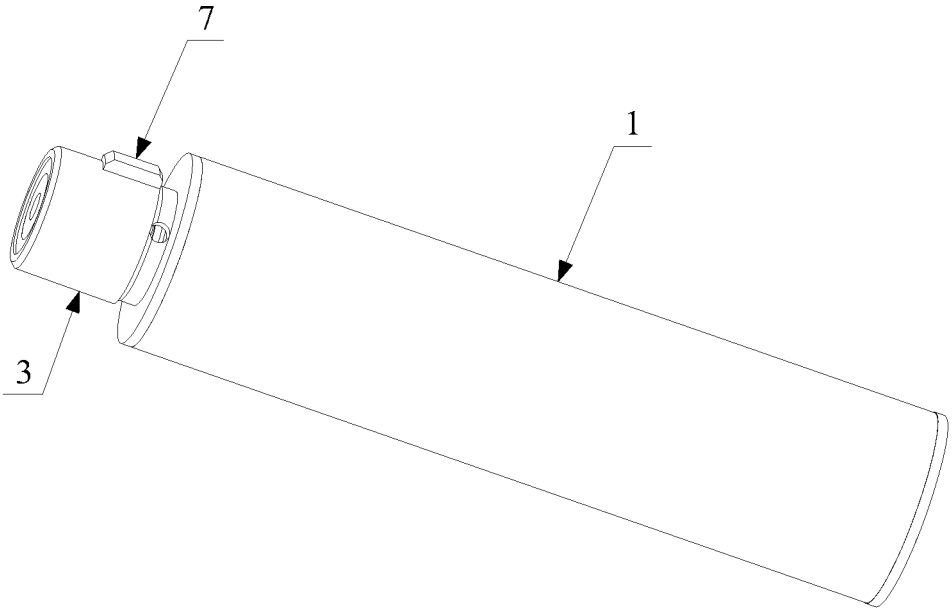
FIG. 6 is a schematic view showing the structure of an atomizer (as an example, one protruding rib is provided in this embodiment)
Figure 7:
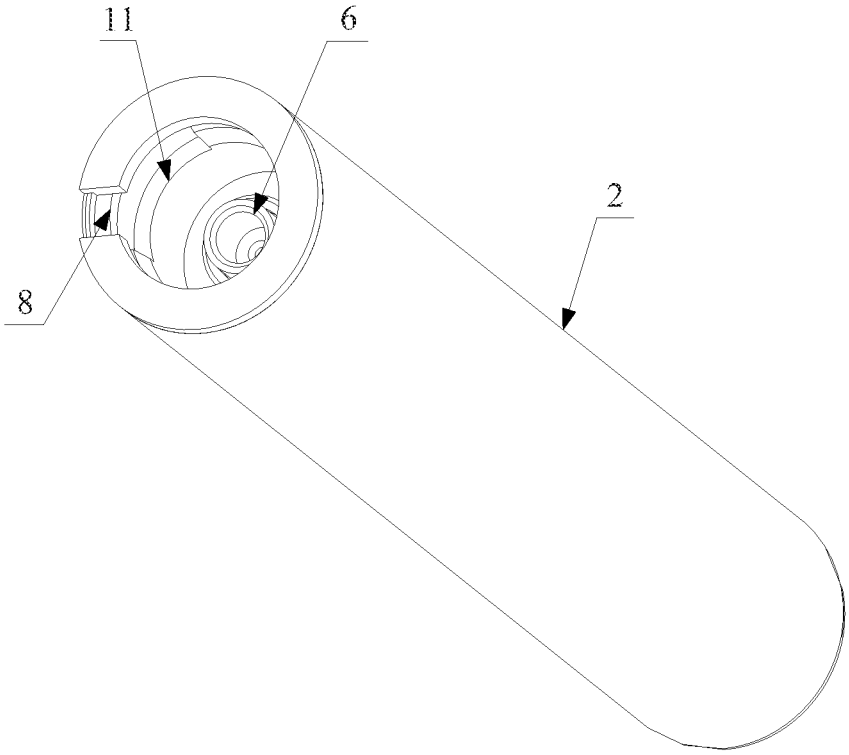
FIG. 7 is a schematic view showing the structure of a battery rod (as an example, one protruding rib is provided in this embodiment)
Figure 8:
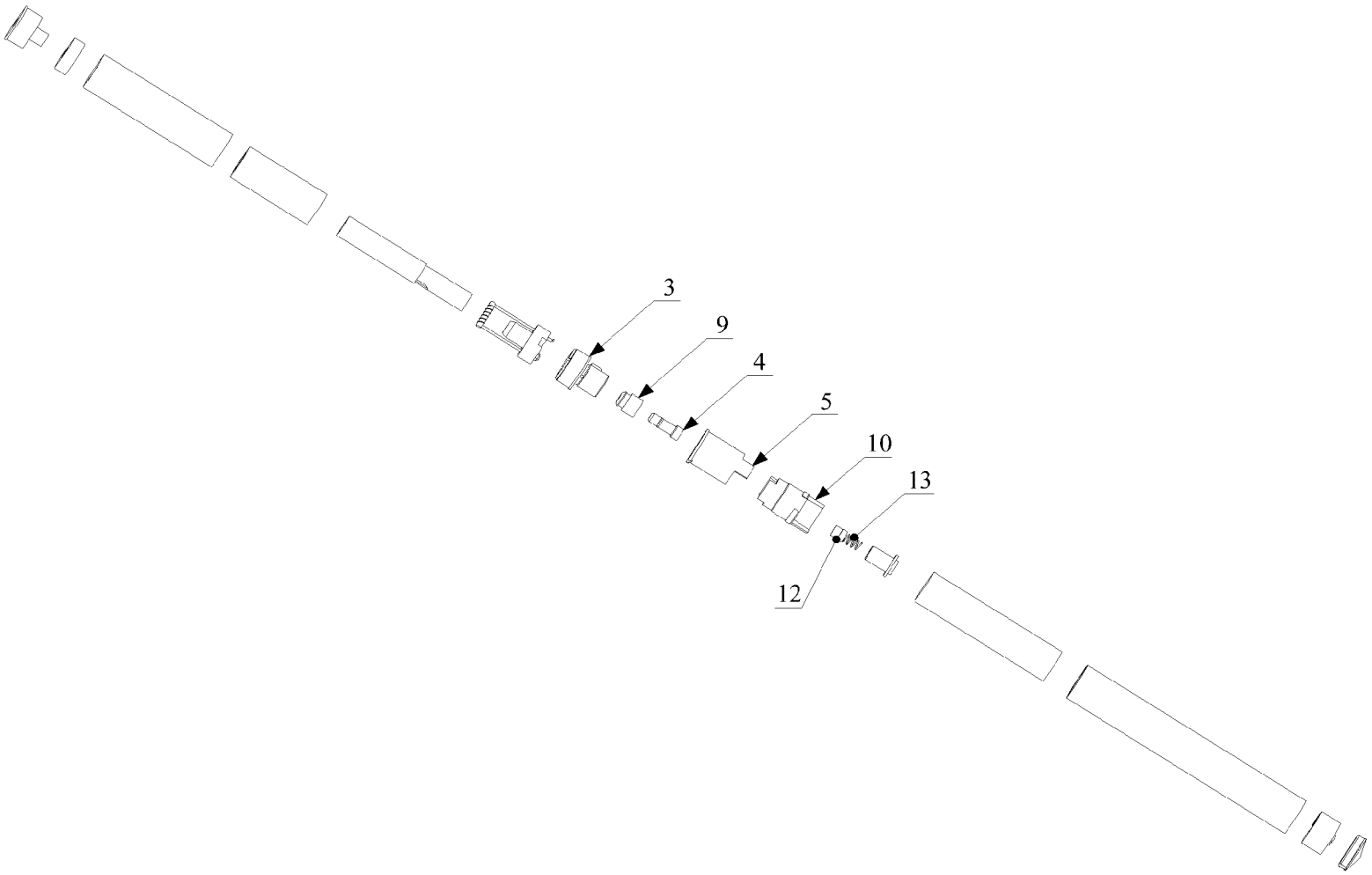
FIG. 8 is an exploded view of an electronic cigarette according to an embodiment of the present application (as an example, one protruding rib is provided in this embodiment)
Figure 9:
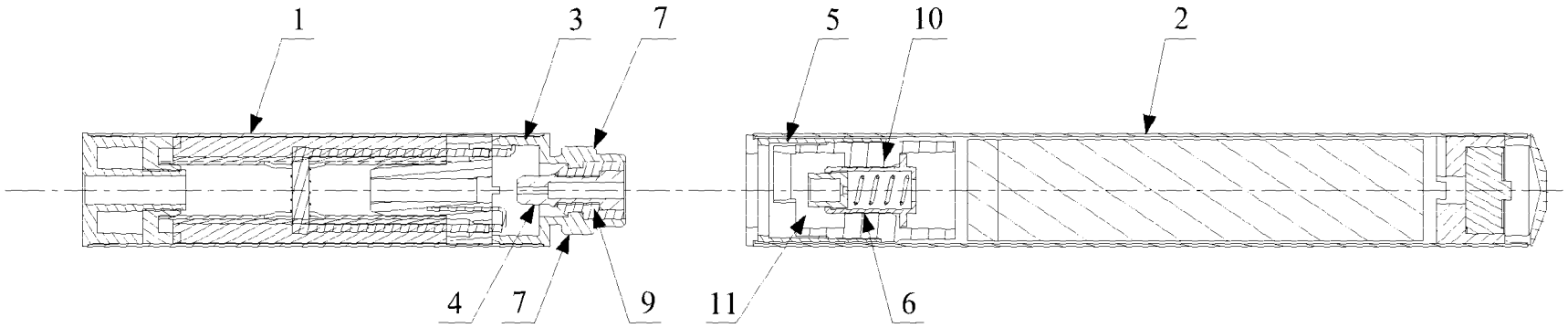
FIG. 9 is a schematic view showing the cooperation of an electrode assembly (as an example, two protruding ribs are provided in this embodiment)
Figure 10:
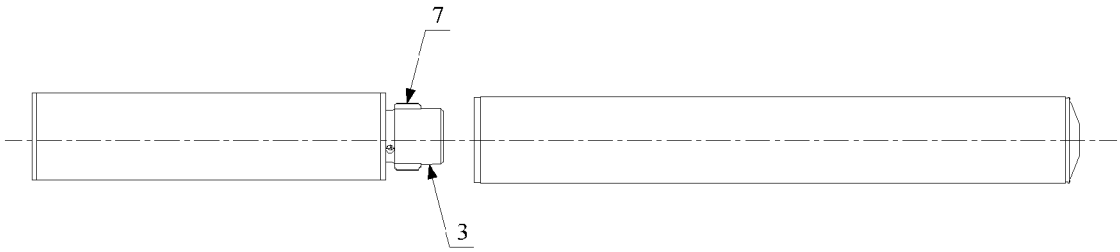
FIG. 10 is a schematic view showing the arrangement manner of the protruding ribs (as an example, two protruding ribs are provided in this embodiment)
Figure 11:
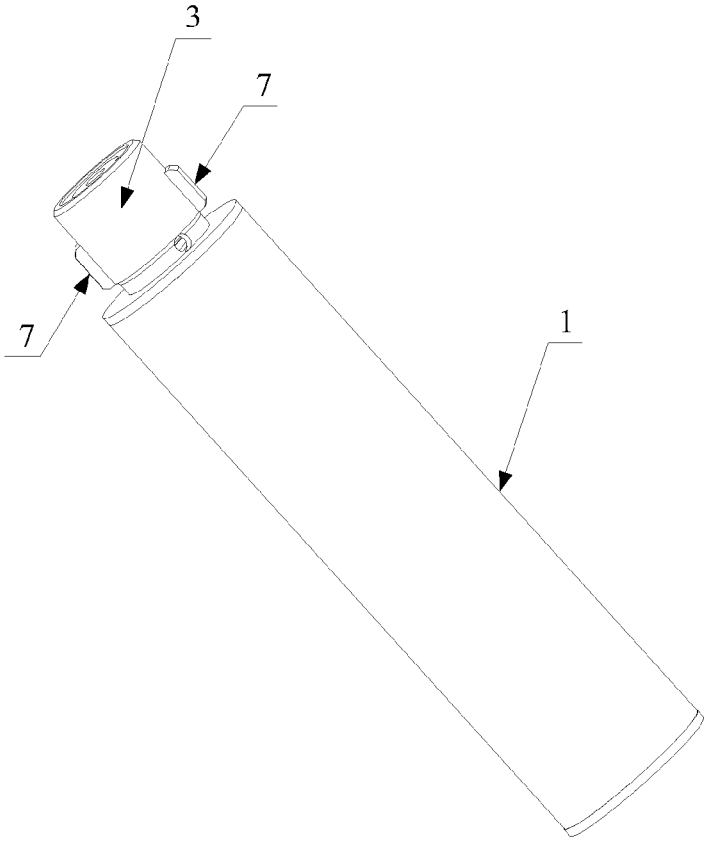
FIG. 11 is a schematic view showing the structure of an atomizer (as an example, two protruding ribs are provided in this embodiment)

In order to further optimize the above technical solution, as shown in FIG. 6 and FIG. 7, in the electrode assembly according to the present embodiment, an outer periphery surface of the atomizer outer electrode 3 is provided with a protruding rib 7, and an inner periphery surface of the battery rod outer electrode 5 is provided with a groove 8 configured to receive the protruding rib 7 and extending in an axial direction of the battery rod 2. Since the atomizer outer electrode 3 and the battery rod outer electrode 5 may be used to connect the atomizer 1 to the battery rod 2, in order to strengthen the firmness of the connection, the protruding rib 7 is arranged on the outer periphery surface of the atomizer outer electrode 3, and the groove 8 is arranged on the inner periphery surface of the battery rod outer electrode 5. When assembling the atomizer outer electrode 3 and the battery rod outer electrode 5, the atomizer outer electrode 3 is inserted into the battery rod outer electrode 5, and the protruding rib 7 on the outer periphery surface of the atomizer outer electrode 3 enters into the groove 8 on the inner periphery surface of the battery rod outer electrode 5 and slides along the groove 8 while the atomizer outer electrode 3 is moving further until the atomizer outer electrode 3 and the battery rod outer electrode 5 is coupled. Apparently, the protruding rib 7 may also be arranged on the battery rod outer electrode 5, and the groove 8 may be arranged on the atomizer outer electrode 3, and the arrangement manner of the protruding rib 7 and the groove 8 is not limited herein.

In the present embodiment, there may be one or more protruding ribs 7 arranged on the atomizer outer electrode 3, and the number and locations of the grooves 8, arranged on the battery rod outer electrode 5 and cooperated with the protruding ribs 7, are corresponding to the number and locations of the protruding ribs 7, as shown in FIGS. 9 to 13.

As shown in FIGS. 4, 8, 9 and 13, the atomizer inner electrode 4 is a rod-shaped electrode and is arranged in an inner cavity of the atomizer outer electrode 3 via an insulating ring 9. In the present embodiment, in order to make the distribution of components more compact, the atomizer inner electrode 4 is configured to have a rod shape so as to save space, and the atomizer inner electrode 4 is arranged in the inner cavity of the atomizer outer electrode 3 via the insulating ring 9 so as to maximize space utilization. An outer lateral surface of the insulating ring 9 is in contact with the inner periphery surface of the atomizer outer electrode 3, and the atomizer inner electrode 4 is arranged in an inner hole of the insulating ring 9, such that the insulating ring 9 may not only support the atomizer inner electrode 4, but may also insulate the atomizer inner electrode 4 from the atomizer outer electrode 3, thereby avoiding a short circuit of the conducting circuit.

Similarly, the battery rod inner electrode assembly is arranged in an inner cavity of the battery rod outer electrode 5 via an insulating electrode holder 10, and the insulating electrode holder 10 may also support the battery rod inner electrode assembly and insulate the battery rod inner electrode assembly from the battery rod outer electrode 5, thereby further reducing the assembly space. The electrode holder 10 is a plastic seat and is provided with a mounting hole, and the battery rod inner electrode assembly is arranged in the mounting hole.

Figure 12:
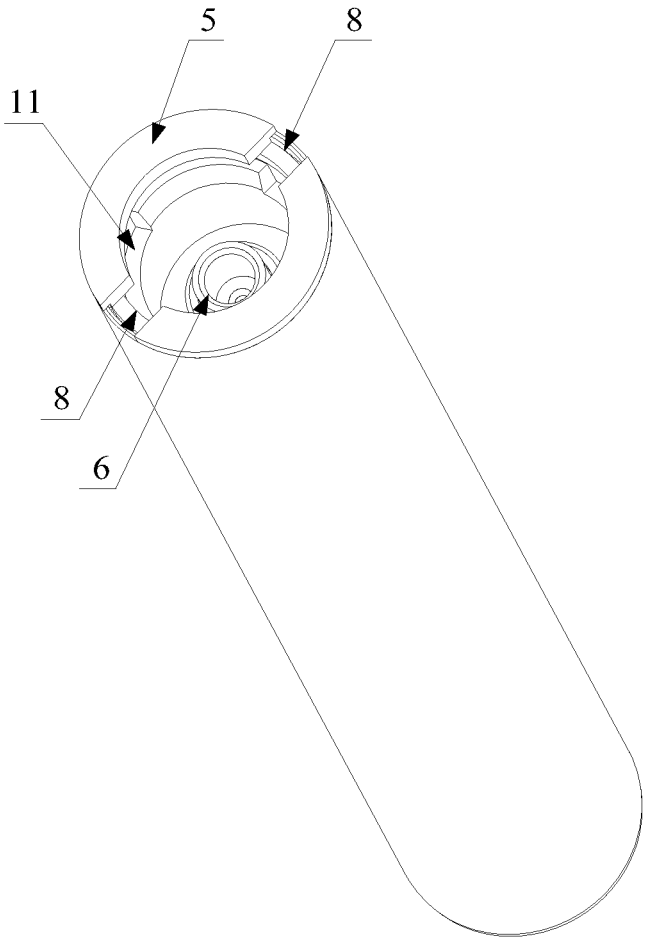
FIG. 12 is a schematic view showing the structure of a battery rod (as an example, two protruding ribs are provided in this embodiment)
Figure 13:
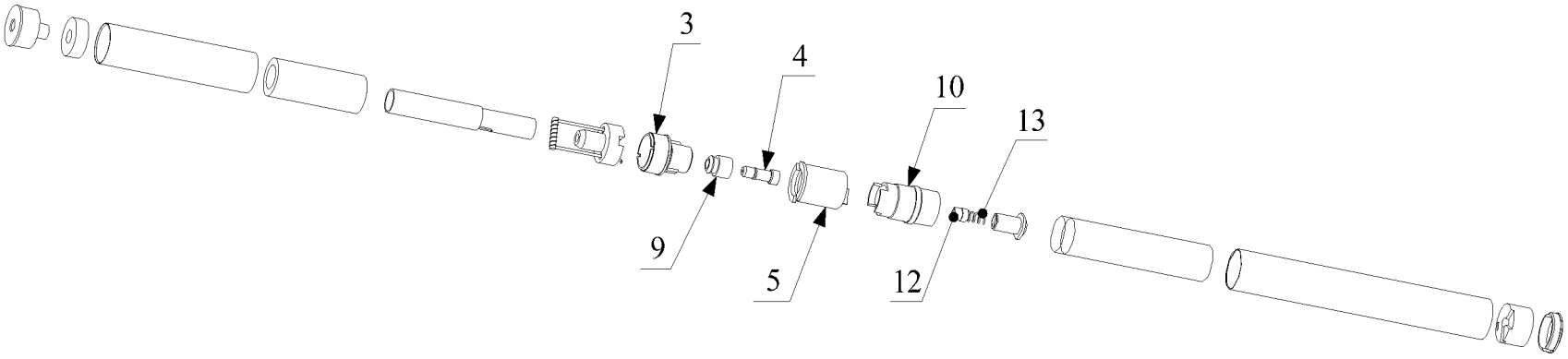
FIG. 13 is an exploded view of an electronic cigarette according to an embodiment of the present application (as an example, two protruding ribs are provided in this embodiment).

Furthermore, as shown in FIG. 7 and FIG. 12, when the groove 8 is arranged on the battery rod outer electrode 5, an inner periphery surface of the insulating seat is provided with a stopping groove 11 extending in a circumferential direction of the insulating seat. The stopping groove 11 communicates with the groove 8 on the battery rod outer electrode 5 and forms a sliding groove distributed in a right-angled form together with the groove 8. After the protruding rib 7 on the atomizer outer electrode 3 reaches an end portion of the groove 8, the atomizer 1 can not move further along an axis of the battery rod 2, such that the atomizer 1 is mounted in place in the axial direction of the battery rod 2. Then, the atomizer 1 is rotated, the protruding rib 7 on the atomizer 1 enters into the stopping groove 11 communicated with the groove 8 through the groove 8, and after the atomizer 1 is rotated by a certain angle, the protruding rib 7 is moved to an end portion of the stopping groove 11, and at this time there is no more space for the protruding rib 7 to move, such that the protruding rib 7 is stopped by the stopping groove 11, thereby limiting a rotating angle of the protruding rib 7, and at this time the atomizer 1 is mounted in place completely.

The battery rod inner electrode assembly according to the present embodiment includes:

an inner electrode body 12 configured to be in contact with and electrically connected to the atomizer inner electrode 4;

an inner electrode sleeve 6 arranged in the mounting hole of the electrode holder 10 and welded to the battery to form an electric connection; and a compression spring 13 arranged between the inner electrode body 12 and the battery of the electronic cigarette, and having two ends respectively welded to the inner electrode body 12 and the battery.

The inner electrode body 12 may be electrically connected to the rod-shaped atomizer inner electrode 4 in a contacting manner. The inner electrode body 12 may be of a rod shape, or of other structures. Preferably, as shown in FIG. 7 and FIG. 12, the inner electrode body 12 is of a cylindrical structure having a base in the present embodiment. Since the cylindrical electrode body 12 having a base has an inner cavity, the rod-shaped atomizer inner electrode 4 may be easily inserted therein, which further increases the contacting area, thereby ensuring a good contact between the atomizer inner electrode 4 and the battery rod inner electrode assembly, and providing a further security guarantee for electrical connection of the circuit.

A conductive spring which is always in a compressed state is arranged between the electrode body 12 and the battery, two ends of the compression spring 13 are welded on the battery and the inner electrode sleeve 6 respectively, such that the battery rod inner electrode assembly is electrically connected to the battery directly, and a tightly connecting contact can be ensured under the action of a pressing force of the compression spring 13, thus a poor contact can be avoided. Further, the battery rod outer electrode 5 is directly welded to the battery of the electronic cigarette, thereby omitting the conventional PCB. Thus, not only the complicated conventional structure is simplified and the production cost is reduced, but also the connecting sensitivity between the battery rod inner electrode assembly and the battery won't be affected and the connection firmness is improved.

Based on the electrode assembly in the above embodiments, an embodiment of the present application further provides an electronic cigarette having the electrode assembly according to the above embodiments.

Since the electronic cigarette employs the electrode assembly according to the above embodiments, beneficial effects of the electronic cigarette produced by the electrode assembly can refer to corresponding parts in the above embodiments, which will not be described herein.

Various embodiments in the specification are described in a progressive manner. Each of the embodiments is mainly focused on describing its differences from other embodiments, and references may be made among these embodiments with respect to the same or similar portions among these embodiments.

Based on the above description of the above described embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

What is claimed is:

1. An electrode assembly, for realizing an electrical connection between an atomizer and a battery rod of an electronic cigarette in a manner of inserting, rotating and coupling, comprising an atomizer outer electrode, an atomizer inner electrode, a battery rod outer electrode and a battery rod inner electrode assembly, all of which being configured to form an electrically conductive loop, wherein, the atomizer outer electrode provided on the atomizer is of a cylindrical shape;

the battery rod outer electrode of a cylindrical shape arranged on the battery rod is configured to be inserted into or sleeved outside the atomizer outer electrode, and then is coupled to the atomizer outer electrode by rotating either the battery rod outer electrode or the atomizer outer electrode;

the atomizer inner electrode provided on the atomizer is in contact with and electrically connected to the battery rod inner electrode assembly provided on the battery rod;

the battery rod inner electrode assembly is arranged in an inner cavity of the battery rod outer electrode via an insulating electrode holder; and the electrode holder is provided with a mounting hole, and the battery rod inner electrode assembly is arranged in the mounting hole; and in the case of the groove being arranged on the battery rod outer electrode, an inner periphery surface of the electrode holder is provided with a stopping groove extending in a circumferential direction of the electrode holder, and the groove on the battery rod outer electrode and the stopping groove form a sliding groove having an angle ranged from 30° to 120°.

2. The electrode assembly according to claim 1, wherein the battery rod outer electrode is electrically connected to a battery of the electronic cigarette.

3. An electronic cigarette, comprising an atomizer, a battery rod, and an electrode assembly for electrically connecting the atomizer to the battery rod, wherein the electrode assembly is the electrode assembly according to claim 1.

4. The electrode assembly according to claim 1, wherein the atomizer inner electrode is a rod-shaped electrode and is arranged in an inner cavity of the atomizer outer electrode via an insulating ring.

5. The electrode assembly according to claim 4, wherein the battery rod outer electrode is electrically connected to a battery of the electronic cigarette.

6. The electrode assembly according to claim 1, wherein a protruding rib is provided on an outer periphery surface of one of the atomizer outer electrode and the battery rod outer electrode each being arranged on a connecting end, and a groove configured to receive the protruding rib is provided on an inner periphery surface of the other of the atomizer outer electrode and the battery rod outer electrode each being arranged on the connecting end.

7. The electrode assembly according to claim 6, wherein the battery rod outer electrode is electrically connected to a battery of the electronic cigarette.

8. The electrode assembly according to claim 6, wherein one or more protruding ribs are provided, and a number and a location of the groove cooperated with the protruding rib are corresponding to a number and a location of the protruding rib.

9. The electrode assembly according to claim 8, wherein the battery rod outer electrode is electrically connected to a battery of the electronic cigarette.

10. The electrode assembly according to claim 1, wherein the battery rod inner electrode assembly comprises:

an inner electrode body configured to be in contact with and electrically connected to the atomizer inner electrode;

an inner electrode sleeve arranged in the mounting hole of the electrode holder and electrically connected to a battery; and a compression spring arranged between the inner electrode body and the battery of the electronic cigarette, and having two ends respectively abutting against the inner electrode body and the inner electrode sleeve.

11. The electrode assembly according to claim 10, wherein the battery rod outer electrode is electrically connected to a battery of the electronic cigarette.

12. The electrode assembly according to claim 10, wherein the inner electrode body is a cylindrical electrode having a base.

13. The electrode assembly according to claim 12, wherein the battery rod outer electrode is electrically connected to a battery of the electronic cigarette.

* * * * *